United States Patent [19]

Lee

[11] Patent Number: 5,003,705

[45] Date of Patent: Apr. 2, 1991

[54] DRYING SYSTEM

[76] Inventor: Shin-Ye Lee, No. 19-2, Szu-Wei St., Shiao-Chia Chen, Tainan Hsien, Taiwan

[21] Appl. No.: 557,007

[22] Filed: Jul. 25, 1990

[51] Int. Cl.[5] ..... F26B 21/00

[52] U.S. Cl. ..... 34/54; 34/98; 34/202; 34/90

[58] Field of Search ..... 34/47, 44, 54, 191, 34/62, 99, 98, 97, 202, 90, 91, 57 A, 57 B; 4/146; 219/366

[56] References Cited

U.S. PATENT DOCUMENTS

| | | | |
|---|---|---|---|
| 2,015,956 | 10/1935 | Moseley | 34/98 |
| 2,057,033 | 10/1936 | Kelley | 34/98 |
| 3,128,161 | 4/1964 | Hudon | 34/202 |
| 3,277,582 | 10/1966 | Munro et al. | 34/57 A |
| 3,449,838 | 9/1966 | Chancellor, Jr. | 34/90 |
| 3,587,118 | 6/1971 | Compton | 4/146 |
| 3,878,621 | 4/1975 | Duerre | 34/90 |
| 4,305,210 | 12/1981 | Christensen et al. | 34/57 B |
| 4,871,900 | 10/1989 | Hickman | 219/366 |

*Primary Examiner*—Henry A. Bennet
*Assistant Examiner*—Denise L. F. Gromada
*Attorney, Agent, or Firm*—Fleit, Jacobson, Cohn, Price, Holman & Stern

[57] ABSTRACT

The drying system includes an air compressor, a compressed air storage tank, a pressure reducing device, a manifold, a heat device, two delivering devices, an electromagnetic control device and a plurality of drying apparatuses. The control device actuates the delivering devices to let out hot and cool air alternatively. Each of the drying apparatuses includes a housing with a top portion, an intermediate portion and a base portion. An air buffer chamber is supplied by the delivering devices, is disposed in the base portion of the housing. A plurality of air distributing devices is respectively disposed in the top portion, the intermediate portion and the base portion. The air buffer chamber has a plurality of tubes with branches respectively and correspondingly connected to the air distributing members. A water guiding device is disposed on top of the base portion of the housing. The housing also has a plurality of air outlets to let out regulated air with uniform pressure.

7 Claims, 5 Drawing Sheets

DRYING SYSTEM

BACKGROUND OF THE INVENTION

The present invention relates to a drying system, more particularly to a drying system whereby a plurality of drying apparatuses cooperate to blow hot and/or cool air over the entire body of the user.

Hygiene is a most important matter, and concerns everyone. Most of the towels provided for users of public bathing areas, such as a hotel or swimming pools, can not be considered very hygienic. So a person concerned about hygiene must bring a his or her own towel from his/her home. A towel is a bulky burden and is very inconvenient for a business or holiday traveler to carry.

SUMMARY OF THE INVENTION

It is therefore a main object of the present invention to provide a drying system whereby a plurality of drying apparatuses cooperate to blow hot and/or cool air to dry a wet body.

Another object of the present invention to provide a drying system that can heat a bathroom to an appropriate temperature, especially during the winter season.

Still another object of the invention is to provide a drying system that can provide air to a plurality of drying apparatuses in such a way that the expense of manufacture is cut, by eliminating the need to install fan device in each of the plurality of drying apparatuses.

According to the present invention, the drying system includes a plurality of drying apparatuses; an air compressor to supply air to the plurality of drying apparatuses; a compressed air storage tank connected to said air compressor and supplied by the same; a pressure reducing means connected to said compressed air storage tank; a heat element; a manifold connected to said pressure reducing means and having a first and a second delivering device, said second delivering device being passed through said heat element so that the air existing from said second device is heated, said first and said second devices being connected to said plurality of drying apparatuses; an electromagnetic controllal valve connected to said first and said second delivering devices and controlling the same in such a manner so as to alternatively let out cool and/or hot air from said first and said second delivering devices.

Each of the drying apparatuses has a vertical housing, including a generally horizontal base portion with a top wall, a generally vertical intermediate portion with an inner wall and a generally horizontal top portion with a bottom wall. The top wall of the base portion, the inner wall of the intermediate portion and the bottom wall of the top portion together define a would be drying space wherein a user stands on the base portion. An air distributing device includes a plurality of air distributing members installed separately in the top portion, the intermediate portion and the base portion of the housing. Each of the air distributing members has a plurality of channels, each one of which has a plurality of partitions formed therein. An air buffer chamber is disposed in the base portion of the housing and is connected to the first and the second delivering devices. The air buffer chamber has a plurality of tubes with branches respectively and correspondingly connected to the plurality of partitions via the plurality of channels in the air distributing members. A plurality of air supplying members is interposed between the air distributing members and the drying space. The housing further includes a control switch and a water guiding device at the base portion.

BRIEF DESCRIPTION OF THE DRAWING

Other features and advantages of the present invention will become apparent in the following detailed description of the preferred embodiments of the present invention, with reference to the accompanying drawings, in which.

DETAILED DESCRIPTION OF THE PREFERRED EMBODIMENT

Figure 1:
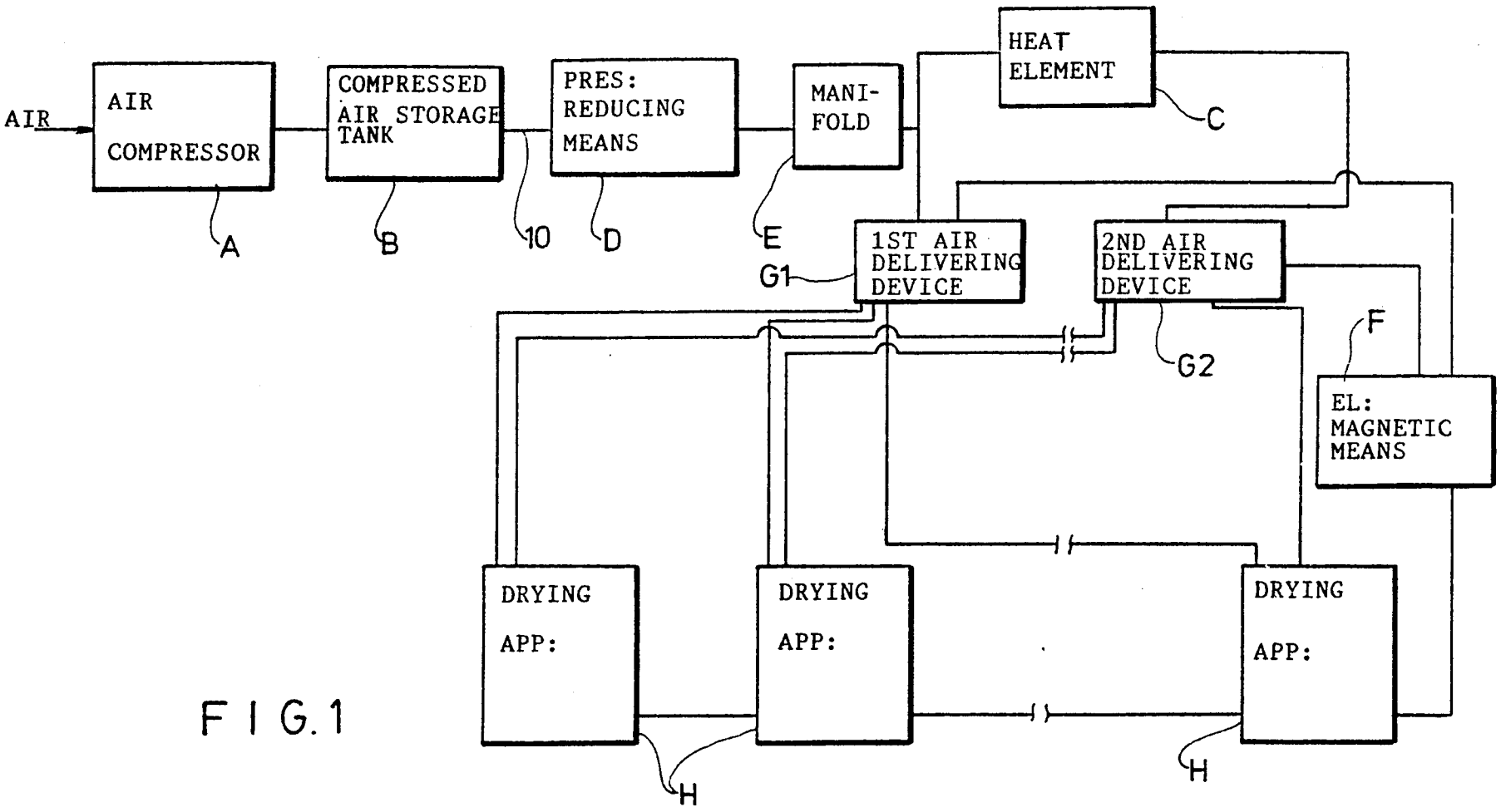
FIG. 1 is a block diagram of the drying system showing the connecting structure of the preferred embodiment according to the present invention.

FIG. 1 shows a block diagram of a drying system according to the present invention. Accordingly, it includes a plurality of drying apparatuses H; an air compressor (A) to supply air to the plurality of drying apparatuses; a compressed air storage tank (B) connected to the air compressor (A) and supplied by the same; a pressure reducing means (D) connected to said compressed air storage tank; a heat device (C); a manifold (E) connected to said pressure reducing means (D) and having a first and a second delivering device (G1) and (G2), said second delivering device (G2) passing through said heat device (C) so that the air coming from the second delivering device (G2) is heated. The first and the second delivering devices are connected to the plurality of the drying apparatuses; and an electromagnetically controllal means (F) is connected to the first and the second delivering device and controls in such a way so as to let out hot and cool air alternatively from the first and the second delivering devices.

Figure 2:
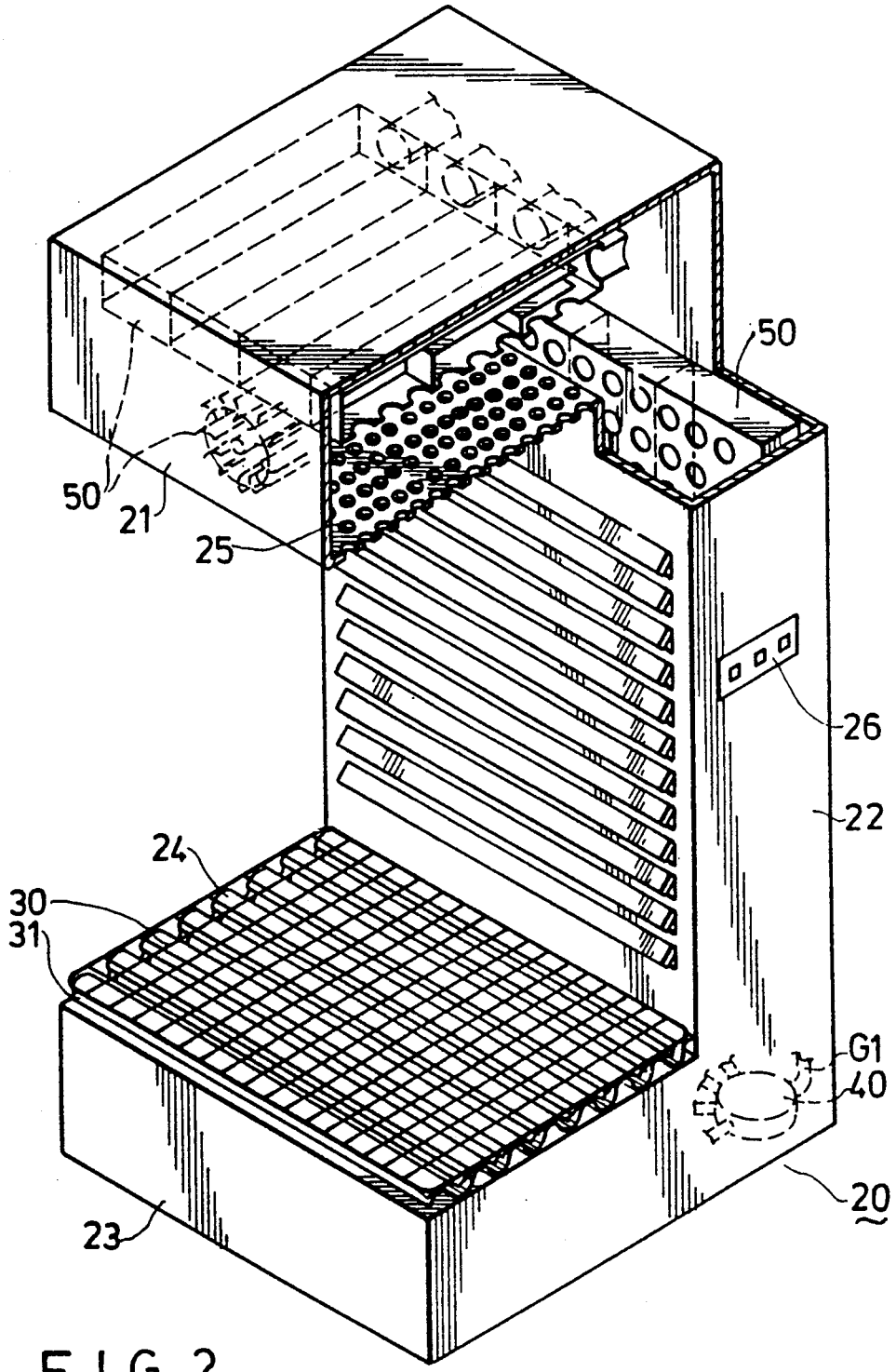
FIG. 2 is a partially exploded view showing the air distributing members of the drying apparatus according to the present invention.
Figure 3:
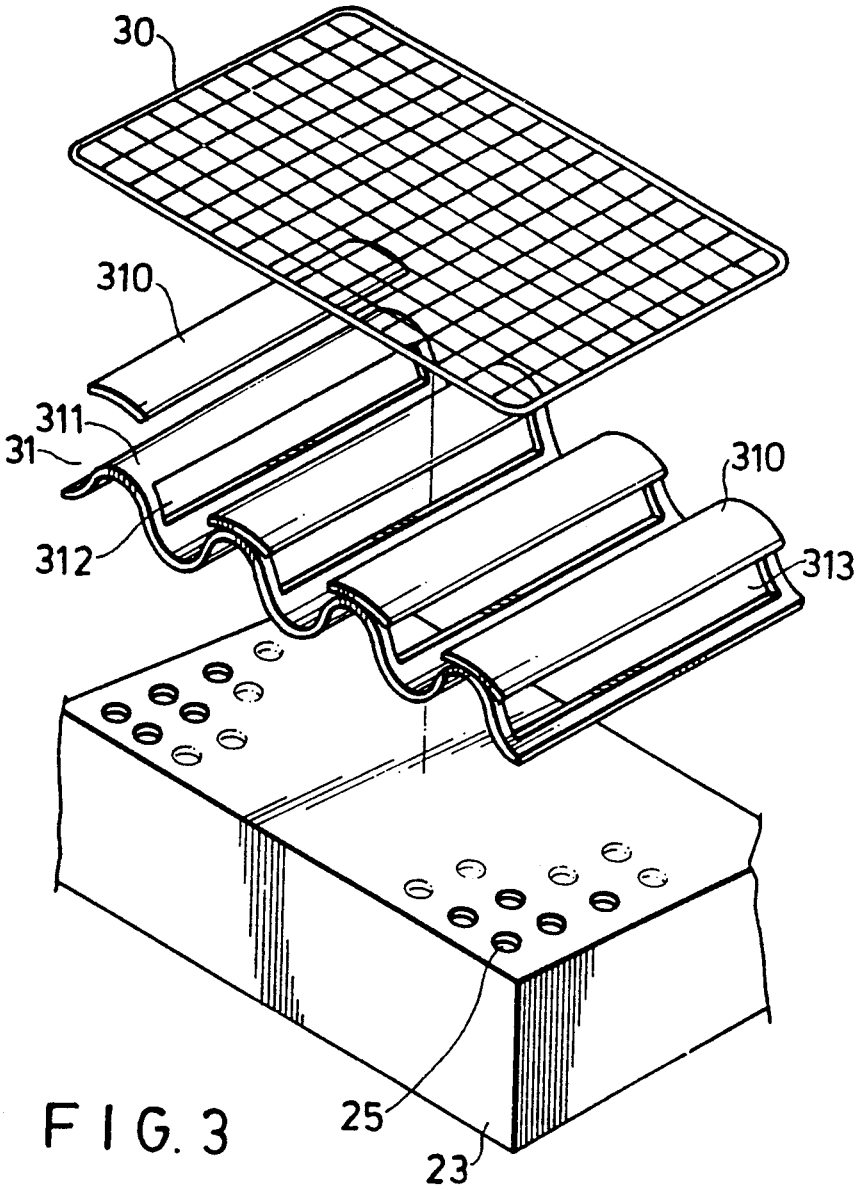
FIG. 3 is an exploded view of the water guiding device of the drying apparatus according to the present invention.
Figures 4A, 4B:
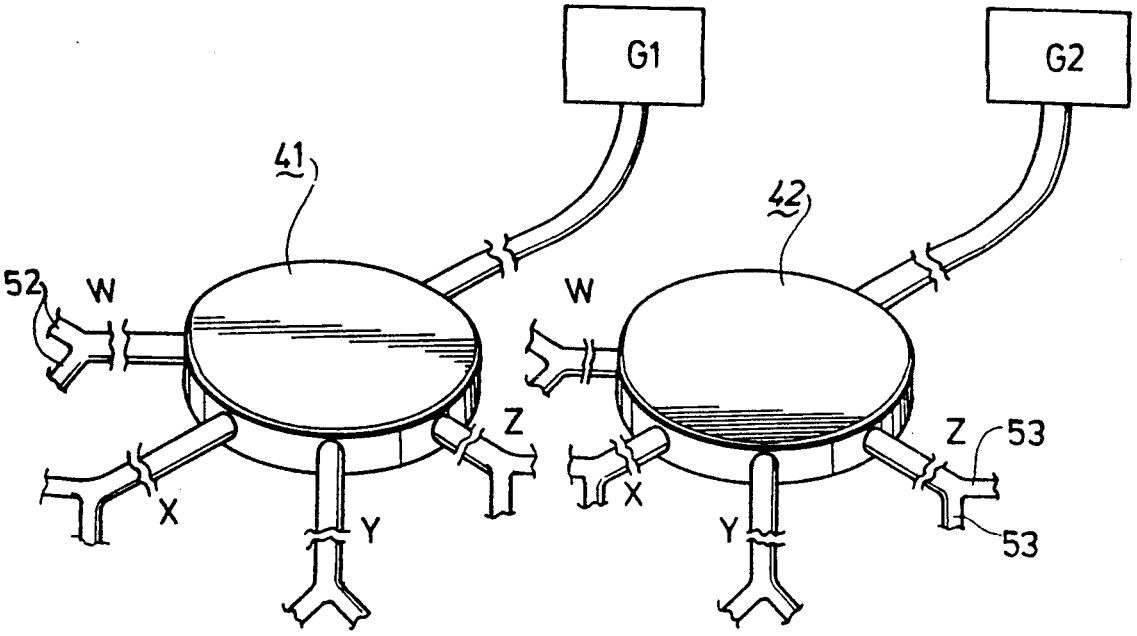
FIG. 4 (A) and FIG. (B) are enlarged views of air buffer chambers of the drying apparatuses of the present invention.

Referring to FIGS. 2 and 3, a drying apparatus of the drying system of present invention includes a housing 20, a plurality of air distributing members 50, and air buffer chamber 40, a control switch 26, a plurality of blowing means (shown in FIGS. 5 and 6) and a water guiding device 5. The housing 20 has a substantially horizontal top portion 21 with a bottom wall, a substantially vertical intermediate portion 22 with an inner wall and a base portion 23 with a top wall. The bottom wall of the top portion 21, the inner wall of the intermediate portion 22 and the top wall of the base portion 23 together define a drying space in which a bather can stand, his foot on the base portion.

As illustrated in FIG. 3, the base portion 23 has a plurality of air outlet 25 on its surface and a water guiding device 31 including an corrugated plate 311 placed on top of the same, and a net plate 30 placed on the corrugated plate 311 so that the user can stand on the net plate. The corrugated plate 311 includes a plurality of peak portions 312, each of which has a plurality of slots 313 therein. A plurality of parallel water shielding plates 310 are fixed atop of the peak portions 312 of the corrugated plate 311 so as to prevent the downward flowing water from entering the slots 313 in the corrugated plate 311. The entrance of water into the slots 313 can result damage to the air blowing means disposed in the base portion 23 of the housing 20.

Figure 5:
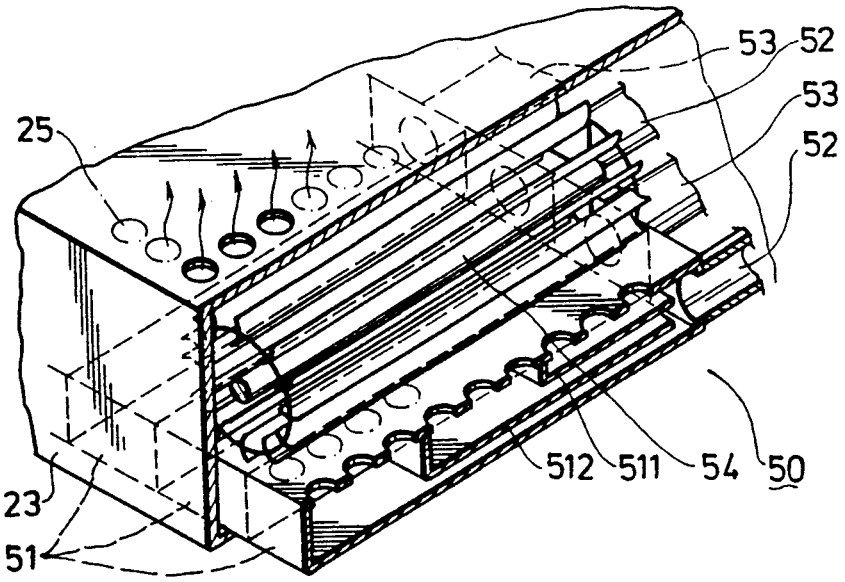
FIG. 5 is an enlarged and detailed view of the air distributing member of the drying apparatus of FIG. 2.

An air distributing device includes a plurality of air distributing members 50 respectively disposed in the top portion, the intermediate portion and the base portion. As shown in FIG. 5, each of said air distributing members has plurality of channels 51, each of said channels has a plurality of partitions 511 and 512 formed therein.

Figure 6:
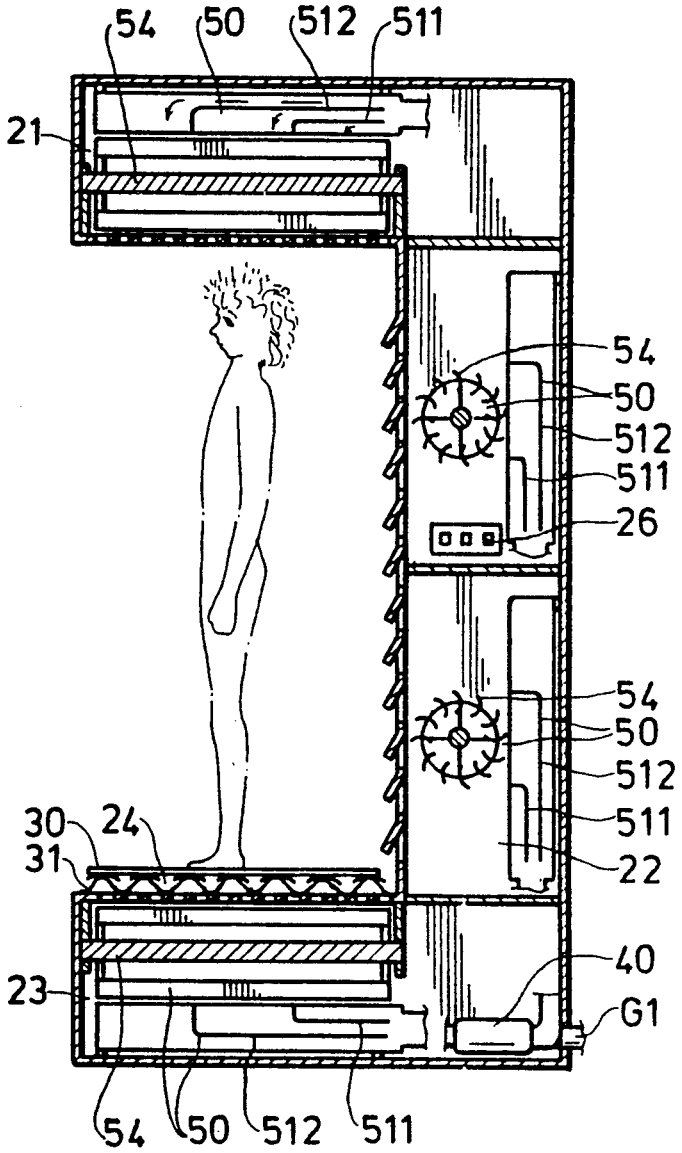
FIG. 6 is a perspective view of a drying apparatus according to the present invention.

Referring to FIGS. 2, 4(A), 4(B) and 6, An air buffer chamber 40 is disposed in the base portion of the housing 20, to regulate the temperature of cool and hot air, being supplied to it by the first and the second delivering device s (G1) and (G2). It has a plurality of tubes W, X, Y and Z with branches 52 and 53 respectively and correspondingly connected to the plurality of partitions 511 and 512 via the plurality of channels 51 of the air distributing members 50. A plurality of blowing means are respectively interposed between the air distributing members and the bottom wall of the top portion, the inner wall of the intermediate portion and the top wall of the base portion, each of the bottom wall, the inner wall and the top wall has a plurality of air outlets to let out regulated air with uniform pressure over the entire body of the user standing in the drying space, as shown in FIG. 6.

A control switch 26 is operatively connected to the electromagnetic control means to activate the same, which in turn actuates the first and the second delivering devices to let out hot and cool air alternatively into the air buffer chamber 40.

While the invention has been described in connection with what is considered to be the most practical and preferred embodiment, the invention is not to be limited to the disclosure only, but on the contrary, it is intended to cover various modifications and equivalent arrangements within the broadest interpretation of the present invention so as to emcompass all such modifications and equivalent arrangements.

I claim:

1. A drying system comprising:

a plurality of drying apparatuses;

an air compressor to supply air to said plurality of drying apparatuses;

a compressed air storage tank connected to said air compressor and supplied by the same;

a pressure reducing means connected to said compressed air storage tank;

a heat supplying device;

said pressure reducing means having a first air delivering device and a second air delivering device, said second air delivering device passing through said heat device so that the air coming out of said second air delivering device is heated, said first and said second air delivering devices being connected to said plurality of drying apparatuses; and an electromagnetic control means connected to said first and said second air delivering devices and controlling the same in such a manner as to let out hot and cool air alternatively from said first and said second air delivering devices.

2. A drying system as claimed in claim 1, wherein said electromagnetic control means is a solenoid switch.

3. A drying system as claimed in claim 1, wherein said first and said second air delivering devices are connected to said pressure reducing means via a manifold.

4. A drying system as claim in claim 1, wherein each of said plurality of drying apparatuses further comprises;

a vertical housing having a generally horizontal base portion with a top wall, a generally vertical intermediate portion with an inward wall and a generally horizontal top portion with a bottom wall, said top wall of said base portion, said inner wall of said intermediate portion and said bottom wall of said top portion together defining a drying space in which a user can stand on said base portion;

an air distributing device including a plurality of air distributing members respectively installed in said top portion, said intermediate portion and said base portion, each of said air distributing members having a plurality of channels, said channels having a plurality of partitions formed therein;

and air buffer chamber being disposed in said base portion of said housing and being connected to said first and said second delivering devices, said air buffer chamber having a plurality of tubes with branches respectively and correspondingly connected to said plurality of partitions via said plurality of channels of said plurality of air distributing members;

a control switch being connected to said electromagnetic control valve.

5. A drying system as claimed in claim 4, wherein said drying apparatus further comprises a plurality of air blowing means respectively interposed between said air distributing members and said drying space.

6. A drying system as claimed in claim 4, wherein said base portion of said housing further comprises a water guiding device including:

an essentially corrugated plate placed on said base portion, and having a plurality of peak portions thereon;

a plurality of slots formed in said peak portions of said corrugated plate;

a plurality of water shielding plates fixed on said corrugated plate above said slots so as to prevent downward flowing of water from entering said slots; and a net plate placed on said corrugated plate so that the user can stand thereon.

7. A drying system as claimed in claim 6, wherein said housing further comprises a plurality of air outlets formed respectively in said bottom wall of said top portion, said inner wall of said intermediate portion and said top wall of said base portion, from which regulated air with uniform pressure blows out over the entire of body of the user, standing in said drying space of said housing.

* * * * *